United States Patent [19]

Alexander et al.

[11] 4,401,393

[45] Aug. 30, 1983

[54] PRINTER RIBBON CASSETTE AND FEED MECHANISM

[75] Inventors: Douglas E. Alexander; Charles M. McCray, both of Raleigh, N.C.

[73] Assignee: International Business Machines Corp., Armonk, N.Y.

[21] Appl. No.: 439,009

[22] Filed: Nov. 4, 1982

[51] Int. Cl.[3] ..... B41J 35/28

[52] U.S. Cl. ..... 400/208; 400/196; 400/233; 400/235

[58] Field of Search ..... 400/194, 195, 196, 196.1, 400/207, 208, 208.1, 223, 233, 235, 229, 234, 232

[56] References Cited

U.S. PATENT DOCUMENTS

| | | | |
|---|---|---|---|
| 3,436,245 | 4/1969 | Grundman | 427/200 X |
| 4,053,040 | 10/1977 | McGourty | 400/196.1 X |
| 4,269,520 | 5/1981 | Gabler | 400/196 |

FOREIGN PATENT DOCUMENTS

| | | | |
|---|---|---|---|
| 2452103 | 5/1976 | Fed. Rep. of Germany | 400/234 |

*Primary Examiner*—Edgar S. Burr
*Assistant Examiner*—Charles A. Pearson
*Attorney, Agent, or Firm*—Edward H. Duffield

[57] ABSTRACT

An improved, disposable inexpensive feed mechanism is uniquely incorporated in a cassette having a flexible or movable wall driven by contact with a moving printer carriage or the like. Friction facing of the moving wall cooperates with a fixed friction facing on an interiorly placed portion of a cassette wall with a ribbon between the two friction faces. The friction facing of the movable part has angled fiber elements that engage the ribbon in one direction but slip easily over the ribbon in the opposite direction. The moving printer carriage or the like contacts a movable portion of the cassette wall in each pass and indexes the ribbon slightly to provide a fresh supply across a platen. The platen may be integrally molded as a part of the cassette and can be made of plastic. The entire mechanism is disposable, is contained in a single clean package and is very low cost. No rollers, feed roll drives or motors are required.

7 Claims, 4 Drawing Figures

PRINTER RIBBON CASSETTE AND FEED MECHANISM

FIELD OF THE INVENTION

This invention pertains to reciprocating carriage or print head printing mechanisms in general and specifically to the ribbon indexing means and to ribbon cassettes for holding a supply of inked printing ribbon with ribbon moving means a part thereof.

PRIOR ART

A variety of ribbon cassette devices are known. These mainly employ feed rollers that engage the ribbon and a motor or other rotary drive means for driving the feed rollers that operate either inside of the cassette housing or external thereto. The operation of the feed rollers is to withdraw the ribbon under slight tension from the cartridge and to reinsert it or stuff it into the cartridge through an appropriate entrance opening in the wall thereof or by being inserted into the main chamber of the cartridge itself. Some cartridges contain two reels and ribbon is wound on one and unwound from the other and then reversed, etc. Numerous devices of this sort are known in the prior art. However, the requirement of providing rotary drive means for either type of design just described entails an unnecessary expense in the printer mechanism itself and is a continual source of potential malfunction, wear and service for adjustment, replacement or the like.

OBJECTS OF THE INVENTION

In view of the foregoing shortcomings of the known prior art, it is an object of this invention to provide an improved ribbon cassette and drive mechanism in which no rotary feed rollers or reel drive devices are required.

Yet another object of the present invention is to provide an improved ribbon cassette and ribbon feed mechanism which is expendable when the ribbon is exhausted and which requires no service adjustment during use.

SUMMARY

The foregoing and still other unenumerated objects of the present invention are met as follows. A cassette housing generally comprising side walls and top and bottom covers more or less continuously joined to form an integral unit is provided. An end wall or appropriate side wall of the cassette is cantilever-mounted so that it is not connected to an adjoining wall top or bottom and only one end of this wall is attached. The wall can flex about its attachment point slightly. On a protrusion from the wall, a friction facing is provided that engages one surface of the printer ribbon. An interiorly molded adjoining wall section is spaced apart very slightly from the movable wall section and is parallel with it. On it may be mounted a mating friction facing material on the opposite side of the ribbon surface. These are conveniently mounted near the entrance to the cassette. As the end wall is deflectable, it may be impacted by a moving printer carriage or print head near one extreme of its travel. This will deflect the wall slightly, move the friction facing to drive the ribbon in a feed direction and pull it into the cassette and provide a new supply of inked surface. The ribbon is provided in a continuous loop well known in the art. It is withdrawn from the cassette at an opening which may include friction means to hold the ribbon taut in a resilient fashion. The cassette may also include an integral platen of molded plastic or the like which can be thrown away when the ribbon is exhausted. In general, the ribbon is withdrawn from the cassette at an exit point, is drawn across the surface of the cassette either in the printing machine or integral with the platen and is drawn back in or stuffed into the cassette body by action of the friction facing members forming a one-way drive friction clutch. The entire assembly is very low cost, is silent in operation, does not require adjustment and can be thrown away with the expended ribbon and cartridge assembly at no significant economic burden.

DETAILED SPECIFICATION

Figure 1:
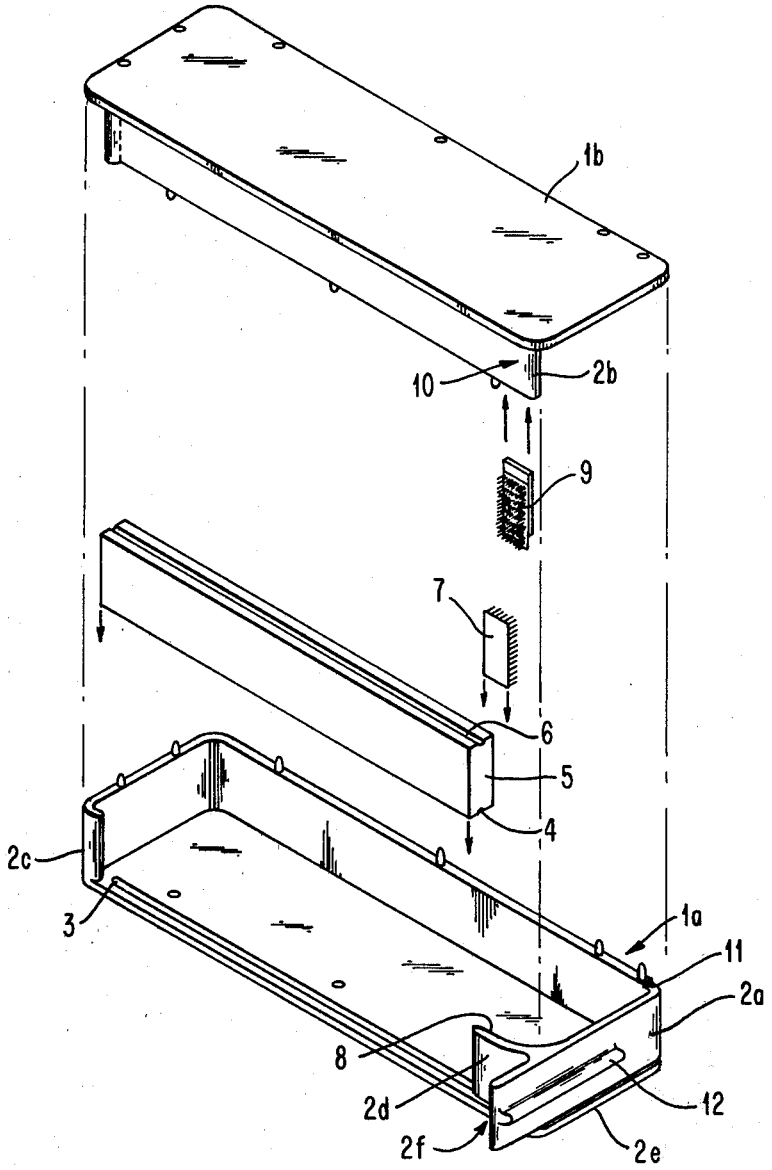
FIG. 1 illustrates an exploded isometric view of the components of the improved ribbon cassette and drive means of the present invention.

Turning to FIG. 1, an exploded diagram of a preferred form of an embodiment of the cassette of the present invention is shown. A ribbon has been omitted for sake of clarity, but will be understood to be contained generally within the housing formed by the base 1A and the cover or lid 1B. The base 1A comprises a cantilever wall portion 2A integrally joined with the back wall near the corner 11. The back wall continues around to form the end wall 2C and is joined to the bottom cover 2E. The wall 2A is not joined to the bottom 2E so it is free to flex about corner 11. Portion 2D is integrally formed with the movable or flexible wall portion 2A and with the extension of wall 2A labeled 2F. The extension portion 2F can be contacted by a moving print head or printer carriage in a machine in which cassette and ribbon drive apparatus may be fixedly mounted. In contacting the portion 2F, the printing carriage not shown can deflect it outward for purposes that will be described later.

A locating rib 3 is integrally molded with the bottom cover 2E on its inner surface. The locating rib 3 acts with groove 4 in platen 5 to hold the platen that is an integral part of this cassette apparatus in the appropriate position. A top locating groove 6 cooperates with a similar locating ridge on the underside of the top cover 1B but the ridge is not visible in this view.

The lid or cover 1B has an integral wall portion 2B molded with it and is so positioned that it lies behind the portion 2D of wall 2A when the cover is assembled with the base 1A.

The ribbon drive means in the present invention comprises two angled fiber brush elements 7 and 9. These are made of a napped fabric such as that constructed under U.S. Pat. No. 3,436,245 and sold generally by the 3M Corporation under the designation Fiber-tran. The brush element 7 is affixed to the backside of the wall extension 2D near the position marked with arrow 8. The brush section 9 is attached to the wall portion 2B near the area marked with arrow 10 so that it is facing the brush portion 7 when the cover 1B is assembled to the base 1A.

Figure 2:
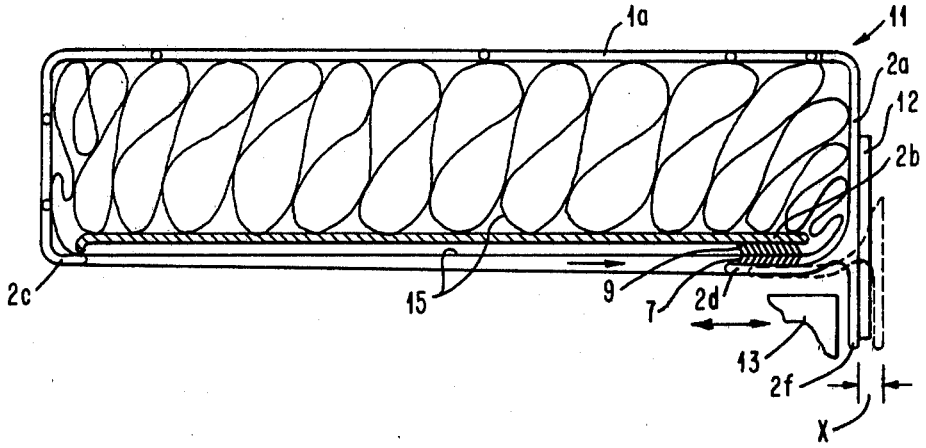
FIG. 2 illustrates a schematic horizontal cross section of the cartridge and mechanism in FIG. 1 in plan view.

FIG. 2 illustrates a top plan view of the assembly shown in FIG. 1 but with the lid 1B and its adjoining element 2B removed. In FIG. 2, the ribbon 12 has been schematically shown in a serpentine stuffed or randomly stuffed fashion contained within the general body of the cassette 1 comprising the walls 1A, 2A, 2C, etc. A moving print head or carriage element 13 is shown as a small section of material 13 that will be understood to move toward the right in FIG. 2 at some portion during the travel of the print head apparatus, for example on the return stroke. The element 13 can contact the wall portion 2F which extends from portion 2D as shown. This will cause a deflection toward the right in FIG. 2 by a distance shown as X. In operation, the preferred embodiment uses a displacement of approximately 4 millimeters. The wall section 2A flexes at corner 11 and the stiffening rib 12 seen better in FIG. 1, tends to limit bending to the corner area 11. Because the wall section 2A is not connected to the lid 1B or the base 2E along this portion of its length, it is cantilever mounted to the wall portion 1A.

The frictional drive element 7 connected to wall portion 2D is seen schematically as an angled set of brush elements. The brush element 9 is affixed to the wall portion 2B and is angled in the same general direction. It may be seen that the two brush elements 7 and 9 confront the ribbon 15 on opposite sides.

Figure 3:
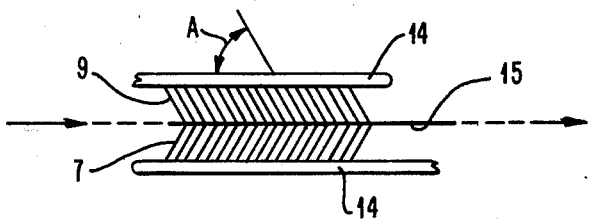
FIG. 3 illustrates in greater detail the ribbon drive means.

In FIG. 3, an enlarged view of the brush elements 7 and 9 with their confrontation against ribbon 15 is shown. It may be seen that the fibers 7 or 9 making up these brush elements are angled at an angle A. This is the nap angle at which the flocking on this flocked fabric having a backing 14 is manufactured. The angle is directed in the direction of the desired motion, in the case, toward the right in FIG. 3. By moving one or the other of the brush elements 7 or 9, the ribbon can be advanced toward the right, but when the brush element moves back toward the left, a greatly decreased friction results and the ribbon is held by the bottom contact with brush 9 for example.

Figure 4:
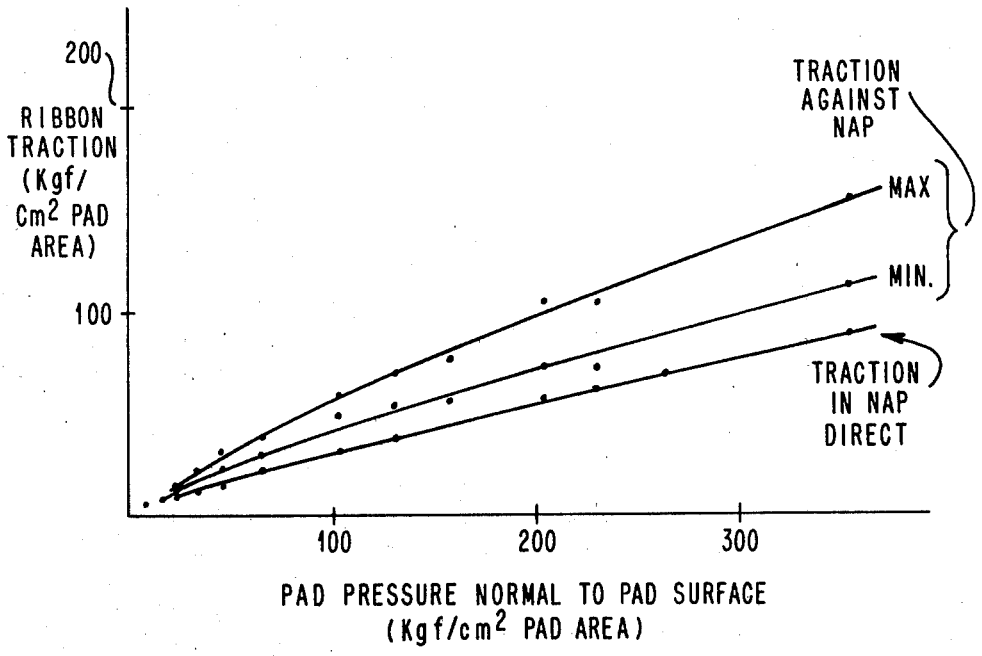
FIG. 4 is a chart of frictional force in a drive direction as opposed to frictional force in the opposite direction for the drive means shown.

Turning to FIG. 4, a plot of the ribbon traction force as a function of pressure normal to the brush surface is drawn. The units are kilograms of force per square centimeter of brush area. The traction force is plotted on the ordinate and the pressure against the ribbon on the abscissa. It will be seen that traction against the nap has a range of maximum to minimum values that is notably above the traction force in the nap direction. Therefore, the ribbon can be drawn in the apparatus as shown in FIG. 2 a short distance by moving brush 7 relative to brush 9 toward the right for example. Then when brush 7 is returned to the left, in this case by the inherent flexibility of the wall section 2A flexing at corner 11, slippage occurs since the traction is greatly reduced.

The casing, platen and other elements other than the flocked fabric brush materials may all be of injection molded plastic as will be understood by those of skill in the art. The ribbon 15 exits from the cassette generally near the end of the wall section 2C as shown in FIG. 2 and enters again between the wall sections 2D and 2B as shown in FIG. 2. Either a single brush element 7 can be used and brush 9 replaced by a segment of the wall 2B of appropriate thickness which may or may not be grooved or otherwise textured as desired, or the two brush elements as shown may be employed. Similarly, a friction means of brush material could be added near the opening at wall 2C to retard the ribbon motion and maintain it taut across the surface of a platen.

The platen element 5 need not be included in the cassette as shown in these figures. The ribbon is exposed across the general length of wall 2B as shown in FIG. 2 and can be inserted in a machine and withdrawn further from the cassette for operation as will be well understood by those of skill in the art. However, for simplicity and low cost, the platen 5 is integral with the cassette as shown in FIG. 1 and is a throw away replacement item that serves well for the life of the ribbon and the cassette and has been discarded as a single assembly.

It will be understood that the moving carriage or print head 13 could contact a drive means on either end of the cassette and that the wall portion 2F is only an example of a means for facilitating contact to cause relative motion to occur between the two napped fabric elements 7 and 9.

INDUSTRIAL APPLICATION

As will be apparent to those of skill in the art, the napped fabric drive arrangement ideally lends itself to the application of an integral ribbon cassette and drive means since the cassette wall can be inexpensively molded in a flexible fashion as shown. The entire combined apparatus and housing is a replacement or throw away item of very low cost, high reliability, and insensitivity to mechanical variations in machines. There are no adjustments required for the life of the ribbon and the elements themselves can be embodied using a variety of materials. Other napped fabric or flocked fabric materials exist besides those described in the present specification and it will be obvious to those of skill in the art to employ any of a variety of these in the same fashion. The overall application of the improved ribbon cassette and drive means to printing operations in the office or business environment are apparent. The entire ribbon is contained within the cassette in a "clean hands", freely replaceable or expendable manner in a low cost package as described.

Having thus described our invention with reference to a preferred embodiment thereof, numerous modifications and departures from the specific design will be apparent to those skilled in the art. Therefore, what is desired to be protected by Letters Patent is set forth in the following claims by way of example and not by limitation.

Having thus described our invention, what we desire to protect by Letters Patent is:

1. A printer ribbon cassette and ribbon feed combination, comprising:

a cassette ribbon housing comprising generally continuous and conjoined top, bottom and side walls, said side walls having at least an exit and an entrance opening therein for withdrawing ribbon from the interior of said cassette and for reinserting said ribbon therein;

one of said side walls being unconnected to the top and bottom walls and attached to the remaining side walls at only one end to be freely flexible in bending about its attachment to the remaining side walls, the remainder of said side walls being connected to the top and bottom walls and to each other;

first frictional drive means mounted in contact with said ribbon and affixed to one end section of said one side wall at the end opposite to the end which is connected to the remaining side walls;

said one end section of said side wall section being flexed and released to move said first frictional drive means along the desired line of travel of said ribbon to withdraw said ribbon from said cassette housing.

2. Apparatus as described in claim 1, and further comprising:

a second said frictional drive means mounted to a fixed portion of a said side wall and in contact with said ribbon on the side thereof opposite to said first frictional drive means.

3. Apparatus as described in claim 1 or claim 2 wherein:

said frictional drive means are located near said entrance opening in said side wall of said cassette to force said ribbon into said entrance and simultaneously withdraw a fresh portion thereof from said exit opening.

4. Apparatus as described in claim 1 or 2 wherein:

said flexible wall portion is contacted by a moving printer carriage or print head to deflect said flexible portion.

5. Apparatus as described in claim 1 or 2, wherein:

said friction means comprise angled fiber faced fabric.

6. Apparatus as described in claim 3, wherein:

said friction means comprise angled fiber faced fabric.

7. Apparatus as described in claim 5 in which:

the angle of said fibers is oriented to face in the direction of the desired ribbon feed with the apex of said angle pointing away from the direction of desired ribbon feed.

* * * * *